US005802192A

United States Patent [19]

Katakawa

[11] Patent Number: 5,802,192

[45] Date of Patent: Sep. 1, 1998

[54] SPEAKER WATERPROOF STRUCTURE FOR ELECTRICAL EQUIPMENT

[75] Inventor: Yukinori Katakawa, Shizuoka, Japan

[73] Assignee: NEC Corporation, Tokyo, Japan

[21] Appl. No.: 679,483

[22] Filed: Jul. 12, 1996

[30] Foreign Application Priority Data

Jul. 13, 1995 [JP] Japan ..... 7-177019

[51] Int. Cl.[6] ..... H04R 25/00

[52] U.S. Cl. ..... 381/188; 381/205; 181/149

[58] Field of Search ..... 381/189, 188, 381/205, 86, 87, 88, 89, 90; 181/149, 150, 199

[56] References Cited

U.S. PATENT DOCUMENTS 2,346,226 4/1944 Marlow ..... 381/189
2,434,469 1/1948 Myers ..... 181/149
3,987,258 10/1976 Tsutsui et al. ..... 381/189
4,989,386 2/1991 Hill ..... 381/189

FOREIGN PATENT DOCUMENTS 59-126328 7/1984 Japan .

*Primary Examiner*—Huyen Le
*Attorney, Agent, or Firm*—Sughrue, Mion, Zinn, Macpeak & Seas, PLLC

[57] ABSTRACT

Outside an electrical equipment housing having a speaker installed therein is installed a vibratory plate member for externally transmitting vibrations of the speaker as a sound and for preventing intrusion of water from outside the housing, and a plurality of sound release holes are formed through the housing, inside the vibratory plate member, for transmitting a sound from the speaker to the vibratory plate member.

3 Claims, 1 Drawing Sheet

SPEAKER WATERPROOF STRUCTURE FOR ELECTRICAL EQUIPMENT

BACKGROUND OF THE INVENTION

The present invention generally relates to a speaker waterproof structure, and particularly, to a waterproof structure for electrical equipment having a speaker.

DESCRIPTION OF THE RELATED ART

There have been known measures for waterproofing electrical equipment having a speaker, such as by accommodating the electrical equipment with the speaker into a waterproof casing or bag or waterproofing the speaker or by having a cover sheet such as a cloth formed with a groove for draining water, achieving a waterproofness substantially equivalent to Class 4 (splash-proof) in the JIS (Japanese Industrial Standards).

For example, Japanese Patent Application Laid-Open Publication No. 59-126328 has disclosed a speaker waterproof structure which employs a waterproof casing or bag for accommodating therein electrical equipment having a speaker.

The conventional speaker waterproof measures for electrical equipment are problematic, such as when the electrical equipment is set to a submerged or splashable service, in that the waterproofness to a speaker as well as the water pressure resistivity is insufficient so that water may intrude from outside the electrical equipment, causing the speaker to malfunction. Accordingly, they are inapplicable such as to electrical equipment that may be submerged or to a use for a leisure subjected to water pressures such as when diving.

The present invention has been achieved with such points in mind.

SUMMARY OF THE INVENTION

It therefore is an object of the present invention to provide a speaker waterproof structure for electrical equipment with a favorable waterproofness as well as a water pressure resistivity, permitting a speaker to keep a normal function even when submerged.

To achieve the object, a genus of the present invention provides a speaker waterproof structure for electrical equipment comprising a speaker installed inside a housing of the electrical equipment, a vibratory plate member installed outside the housing for externally transmitting vibrations of the speaker as a sound and for preventing intrusion of water from outside the housing, and a sound release hole formed through the housing, inside the vibratory plate member, for transmitting a sound from the speaker to the vibratory plate member.

According to a species of the genus of the invention, the vibratory plate member is integrally formed with the housing.

According to another species of the genus of the invention, the vibratory plate member is a separate member relative to the housing.

According to another species of the genus of the invention, the housing includes a reinforcer member for a reinforcement thereof to withstand water pressures, and the sound release hole is formed through the housing.

According to an individual of this species of the invention, the reinforcer member has a variable thickness.

BRIEF DESCRIPTION OF THE DRAWINGS

The objects, features and advantages of the present invention will become more apparent from consideration of the following detailed description, in conjunction with the accompanying drawings, in which.

DESCRIPTION OF THE PREFERRED EMBODIMENTS

Figure 1:
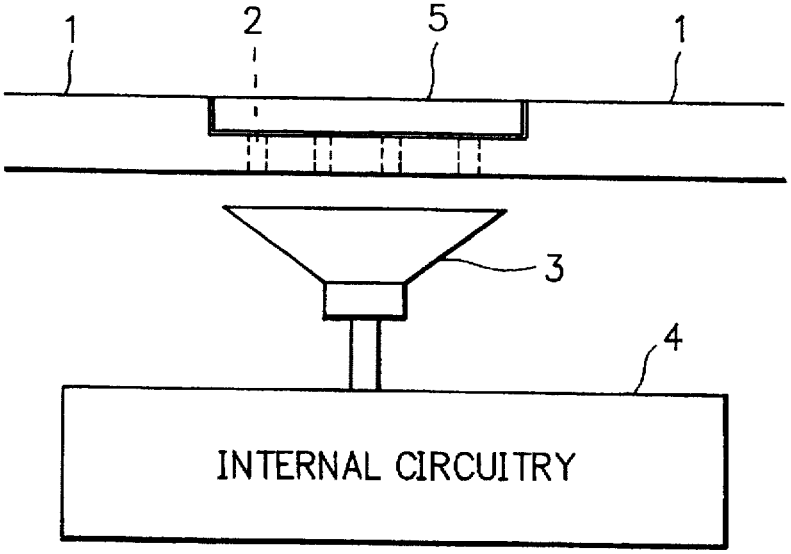
FIG. 1 is a section of a speaker waterproof structure for electrical equipment according to an embodiment of the invention.

There will be detailed below the preferred embodiments of the present invention, with reference to the accompanying drawings. Like members are designated by like reference characters.

FIG. 1 shows a section of a speaker waterproof structure for electrical equipment according to a first embodiment of the invention.

The speaker waterproof structure comprises a speaker 3 installed inside a housing 1 of the electrical equipment and connected to internal circuitry 4 of the electrical equipment, a vibratory plate 5 installed outside the housing 1, as a separate member therefrom, for externally transmitting vibrations of the speaker 3 as a sound and for preventing intrusion of water from outside the housing 1, and a plurality of sound release holes 2 formed through the housing 1, inside the vibratory plate 5, for transmitting a sound from the speaker 3 to the vibratory plate 5.

There will be described below a function of the speaker waterproof structure.

An output signal of the electrical equipment internal circuitry 4 is input to the speaker 3, where it is transduced into a sound (voice inclusive), which is output from the speaker 3. The output sound is transmitted outside the housing 1 via the sound release holes 2.

On the outside of the housing 1 is provided the vibratory plate 5 as a separate member relative thereto for transmitting vibrations of the speaker 3 as well as for preventing water from intruding from outside into the electrical equipment, which plate 5 is connected to the housing 1 by using an adequate ultrasonic welding or adhesive to withstand or endure larger water pressures than 1 atmospheric pressure. The vibratory plate 5 is thus forced to vibrate so that a corresponding sound is finally transmitted outside the electrical equipment proper.

For a sufficient generation of vibrations, the vibratory plate 5 comprises a plate member of a thickness substantially between 0.6 to 0.8 mm. The plate member may be made of a PC (polycarbonate), a PS (polystyrene), an ABS (acrylonitrile-butadiene-styrene copolymer) and the like, and may not be identical in material to the housing 1.

Figure 2:
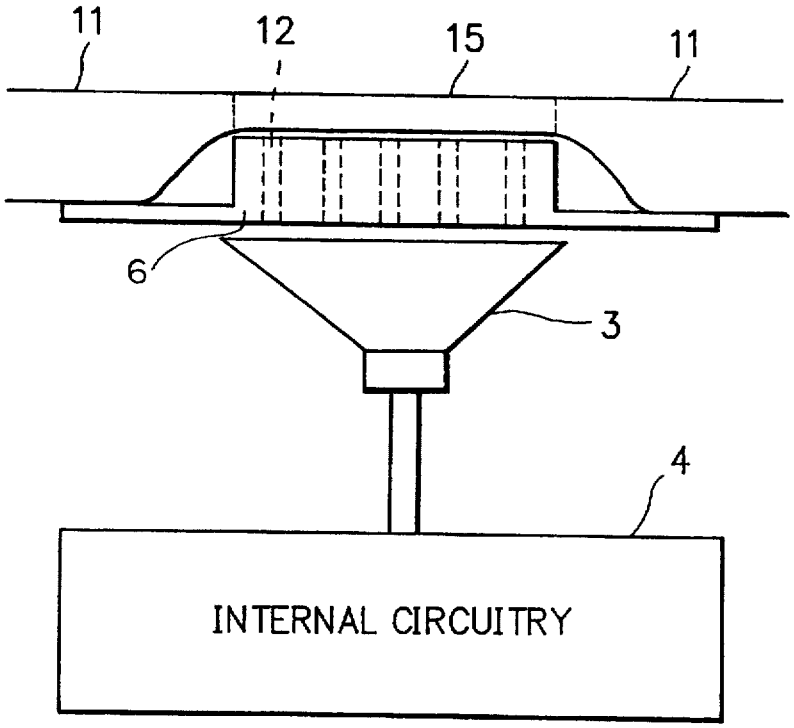
FIG. 2 is a section of a speaker waterproof structure for electrical equipment according to another embodiment of the invention.

FIG. 2 shows a section of a speaker waterproof structure for electrical equipment according to a second embodiment of the invention.

The speaker waterproof structure comprises a Speaker 3 installed inside a housing 11 of the electrical equipment and connected to internal circuitry 4 of the electrical equipment, a vibratory plate 15 installed outside the housing 11, as an integral member therewith, for externally transmitting vibrations of the speaker 3 as a sound and for preventing intrusion of water from outside the housing 11, a reinforcing plate 6 secured to the housing 11, inside the vibratory plate 15, for an adequate reinforcement of the housing 11 to withstand or endure water pressures, and a plurality of sound release holes 12 formed through the reinforcing plate 6 for transmitting a sound from the speaker 3 to the vibratory plate 15.

There will be described below a function of the speaker waterproof structure.

An output signal of the electrical equipment internal circuitry 4 is input to the speaker 3, where it is transduced into a sound (voice inclusive), which is output from the speaker 3. The output sound is transmitted to the vibratory plate 15 via the reinforcing plate 6, which is formed with the sound release holes 12 and fitted in a supporting manner against pressures acting thereon from outside the housing 11 so that the vibratory plate 15 can withstand or endure water pressures, whereby the sound is transmitted outside the electrical equipment proper.

The vibratory plate 15 as well as the housing 11 may be made of a PC (polycarbonate), a PS (polystyrene), an ABS (acrylonitrile-butadiene-styrene copolymer) and the like.

In this respect, the vibratory plate 15 is integrated with the housing 11 and may preferably be made of an identical material to the housing 11. The plate 15 may not be always identical in material to the housing.

For a sufficient generation of vibrations, the vibratory plate 5 comprises a plate member of a thickness substantially between 0.6 to 0.8 mm. The plate member may have a thinner dimension in accordance with requirements such as from the material of the vibration plate 15 and a size and characteristics of the speaker 3.

The reinforcing plate 6 is a separate member relative to the housing 11, and may be made of a plastic or metallic material.

The reinforcing plate 6 may have a variable thickness in dependence on a water pressure the housing 11 is expected to withstand or endure. With an increased thickness, the plate 6 withstands a higher water pressure. With a reduced thickness, it serves for a lower water pressure, but has a reduced size and a reduced total weight.

The speaker waterproof structures described above thus permit the electrical equipment to be installed in places subjected to an intrusion of water from outside or exposed to water pressures.

As will be understood from the foregoing embodiments, a speaker waterproof structure for electrical equipment according to the invention has, outside of a housing of the electrical equipment with a speaker installed therein, an integral or separate vibratory member provided thereon for externally transmitting vibrations of the speaker as a sound and for preventing intrusion of water from outside the housing and withstanding water pressures, permitting the speaker to normally function even when submerged, as well as an adequate waterproofness and an adequate water pressure resistivity, so that it has applications such as to electrical equipment that may be submerged or to a use for a leisure subjected to water pressures such as when diving, without the need of dedicated components such as a waterproof speaker to achieve a favorable sound quality.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A speaker waterproof structure for electrical equipment comprising:

a speaker installed inside a housing of the electrical equipment;

a vibratory plate member installed outside the housing for externally transmitting vibrations of said speaker as a sound and for preventing intrusion of water from outside the housing; and a plurality of sound release holes formed through the housing, inside said vibratory plate member, for transmitting a sound from said speaker to said vibratory plate member, wherein the housing includes a reinforcer member for a reinforcement thereof to withstand water pressures, and said sound release holes are formed through said reinforcer member, and wherein said vibratory plate member is integrally formed with the housing.

2. A speaker waterproof structure according to claim 1, wherein said reinforcer member has a variable thickness.

3. A speaker waterproof structure according to claim 1, wherein said sound release holes are formed between said speaker and said vibratory plate member.

* * * * *